United States Patent [19]

Rebhan et al.

[11] Patent Number: 4,589,234

[45] Date of Patent: May 20, 1986

[54] ARTICLE-TREATING APPARATUS

[75] Inventors: Dieter Rebhan, Gelting; Hartmut Krümpholz, Würzburg, both of Fed. Rep. of Germany

[73] Assignee: Linde Aktiengesellschaft, Wiesbaden, Fed. Rep. of Germany

[21] Appl. No.: 595,265

[22] Filed: Mar. 30, 1984

[51] Int. Cl.[4] ..... B24C 3/14

[52] U.S. Cl. ..... 51/417; 51/436; 222/241; 222/285; 222/413

[58] Field of Search ..... 51/417, 436, 432, 433, 51/419, 420–421, 428, 434, 322, 426, 319; 222/241, 413, 285, 286

[56] References Cited

U.S. PATENT DOCUMENTS

| | | | |
|---|---|---|---|
| 3,191,642 | 6/1965 | Saito | 222/413 |
| 3,445,966 | 5/1969 | Moore | 51/432 |
| 3,486,664 | 12/1969 | Loomans | 222/413 |
| 3,604,157 | 9/1971 | Fogle | 51/417 |
| 3,675,373 | 7/1972 | Putnam | 51/432 |
| 3,790,040 | 2/1974 | Bahr et al. | 222/413 |
| 3,924,357 | 12/1975 | Schmidt | 51/433 |
| 4,164,103 | 8/1979 | Hesse et al. | 51/432 |
| 4,312,156 | 1/1982 | McWhorter | 51/322 |

*Primary Examiner*—Frederick R. Schmidt
*Assistant Examiner*—Robert A. Rose
*Attorney, Agent, or Firm*—Karl F. Ross; Herbert Dubno

[57] ABSTRACT

An apparatus for the deburring or coating removal of workpieces which are subjected to direct heat exchange with a low temperature coolant, e.g. liquid nitrogen, has a transport path extending around a sling wheel to which a granular path medium is supplied via a hollow shaft which is cantilever journaled externally of the treatment chamber. The blast medium is fed to the sling wheel via a nonrotatable tube extending through the hollow shaft so that centrifugal force does not cause free flow media to adhere to the inner walls of the shaft and impede delivery to the sling wheel.

9 Claims, 7 Drawing Figures

ARTICLE-TREATING APPARATUS

FIELD OF THE INVENTION

Our present invention relates to an apparatus for the surface treatment of articles with a blast medium and, more particularly, to an apparatus for the deburring of articles composed of elastic material, e.g. rubber, or other materials and for the removal of coatings such as lacquer from the articles generally after the articles have been treated with a low-temperature medium or simultaneously with such treatment for the embrittlement of the material to be removed, utilizing as a treatment agent a blast medium, e.g. a particulate stream which is cast upon the articles by a slinger rotor.

BACKGROUND OF THE INVENTION

Deburring and like surface treatments utilizing a blast medium, e.g. granules, pellets or other particles of an abrasive or relatively hard substance, or the removal of lacquer and other coatings from articles by a blast medium are techniques which are commonly in use in industry.

For the deburring of rubber or synthetic resin (plastic) material or the comminution thereof or parts thereof, it is advantageous to subject the articles to a preliminary embrittlement treatment, e.g. by deep-cooling them.

The same applies for the embrittlement of lacquer and like coatings of materials which can be more easily removed from workpieces after the latter have been embrittled by deep-cooling. The deep-cooling process can utilize direct heat exchange between the articles and a deep-cooling medium, e.g. a liquefied gas such as liquid nitrogen.

In the past, the deburring technique and/or the surface treatment for coating removal has been effected in a rotary drum, a trough-shaped receptacle in which the articles are given a movement or are radially displaced relative to one another, or even on a rotary inclined table in which the articles can be moved about so that practically all surfaces therein can come into contact with the blast medium. Generally, the blast medium is, as has been noted, a stream of particles which are directed toward or at the workpieces utilizing the centrifugal action of a rotor, e.g. a blast rotor or, as more accurately defined, a sling wheel or rotor which flings the particles at a high velocity by virtue of centrifugal force against the workpieces.

With comparatively large articles to be deburred and/or to be surface-treated with a blast medium, e.g. respirator masks, and other large or bulky articles, problems are encountered with such treatments since the movement of the article to expose all of the surfaces to the blast, particularly when the articles are highly embrittled, may result in undesired breakage.

Without such movement, however, the article may be incompletely deburred or insufficiently treated so that portions of a coating may remain.

The prior-art apparatuses for such surface treatments, especially where the articles were subjected to low temperature treatments prior to the surface treatment, generally operated unsuccessfully.

Of course, other apparatus for the deburring or coating removal of articles are operated with transport systems, e.g. conveyors, which carry the articles through a transport zone or along a transport path extending through the blast zone.

In such arrangements, two or more sling wheels had to be disposed above one another in a common vertical plane or otherwise ganged to ensure full coverage of the workpieces. In a large measure, the drawbacks of these earlier systems were due to the inability to deliver large quantities of the blast medium to the or each sling wheel and/or problems encountered by the requirements for journaling the sling wheel in the region in which the articles were to be subjected to the treatment.

OBJECTS OF THE INVENTION

It is the principal object of the present invention to provide an improved apparatus for the blast treatment of articles whereby the disadvantages outlined above can be obviated.

Another object of the invention is to provide a simple and compact apparatus for the economical treatment of comparatively large or bulky articles for deburring or coating-removal operations whereby these can be carried out with a minimum of loss of the articles, i.e. with a minimum number of rejects.

Still another object of the invention is to provide an improved apparatus for the latter purpose which is especially effective where the articles prior to or even concurrently with the surface treatment are subjected to a low-temperature treatment, e.g. deep-cooling by direct heat exchange with a liquefied gas.

SUMMARY OF THE INVENTION

These objects and others which will become apparent hereinafter are attained, in accordance with the present invention, in an apparatus provided with a conveyor for displacing articles subjected to deep-cooling in direct heat exchange with a liquefied gas and hence to embrittlement of at least surface portions of such articles, into a blast zone provided with at least one sling wheel adapted to cast by centrifugal action on rotation of this wheel, a blast medium against the surfaces of the articles conveyed through this zone for removal of such portions. According to the invention, the sling wheel is mounted on a hollow shaft which is cantilever-journaled on the housing, i.e. the sling wheel is mounted on a free end of the hollow shaft at a location remote from the bearings whereby this hollow shaft is rotationally journaled on the housing supporting the sling wheel. Through the interior of the hollow shaft and fixed to this housing a nonrotating tube extends and means is provided for feeding a blast medium to the sling wheel through the stationary tube which can terminate in an opening of the sling wheel inwardly of the vanes, pockets or like formations provided on the latter to entrain the blast medium and cast it outwardly.

Preferably this shaft and the tube are vertically disposed, i.e. upright, and the supply vessel or bin for the blast medium can be disposed directly above the hollow shaft and the stationary tube, thereby eliminating the need for more complex arrangements of pipes and other tortuous connections from the supply bin to the sling wheel and allowing a straight-line vertical path for the particulates running from the bin to the wheel. Consequently the entire assembly is extremely compact.

In spite of this compact construction, the apparatus of the invention does not suffer disadvantages which might be present in a system in which the blast medium is fed directly into the rotating hollow shaft. In such a case, the centrifugal force would press the blast medium against the inner wall of the hollow shaft and its descent along the hollow shaft would be greatly limited because of the higher friction which would have to be overcome by reason of the centrifugal force.

Because in the system of the invention the blast medium passes through a stationary tube communicating with the hollow shaft by passing through it and never encounters the rotating wall thereof during its travel from the bin to the sling wheel, wall adhesion and friction is minimal.

As a consequence of the free flow of the blast medium through the stationary tube, large amounts of the blast medium can be supplied to the sling wheel and thus it is possible to cast large amounts of this medium against the workpieces in a comparatively short time and thereby improve the rate of deburring and coating removal and even increase the throughput of the articles in the treating zone.

The cantilever journaling of the sling wheel is also advantageous because, since a cryogenic coolant has been utilized to cool the articles and may even be present in the blast zone, and the articles enter the blast zone at an extremely low temperature, the temperature of the blast zone is at an extremely low level.

Because of the cantilever journaling of the sling wheel, the drive for the latter can be disposed outside the blast-treatment zone and protected from the penetration from the cold of this zone as well as from any abrasive attack of the blast medium.

The cantilever journaling of the sling wheel, moreover, can ensure that the space below the sling wheel remains free from any obstructions or structures which might impede the collection and recovery of the blast medium and its processing for recycling.

According to a further feature of the invention, the sling wheel is oscillated in a vertical direction by an appropriate drive. In this case, the bin can be provided with a further pipe which extends into the stationary pipe or, more accurately, the nonrotatable tube which, in turn, is received in and vertically displaceable with the hollow shaft.

The vertical oscillation of the sling wheel increases the vertical zone of attack of the blast medium on the workpieces and hence eliminates the need for two or more such wheels. Here again, the cantilever journaling of the sling wheel is of advantage because it allows such vertical movement by reason of the free space below the sling wheel.

The aforementioned additional pipe, which can be fixed to the supply bin, allows the nonrotatable tube to receive a continuous supply of the blast medium without requiring the bin to move vertically and follow the oscillatory movement.

The stationary pipe can be bipartite and is so dimensioned that the two pipe sections telescopically engage in one another with the upper part affixed relative to the silo or bin as the sling wheel moves up and down.

The deflection of the blast medium from the vertical to the horizontal can be effected by an appropriate configuration of the opening and the center of the sling wheel, e.g. by providing an insert at this mouth having a conical configuration.

The supply of the blast medium to the rotating sling wheel and the hollow shaft (via the nonrotatable shaft) is effected in accordance with a particularly advantageous embodiment of the invention by force feed, e.g. via a worm or the like. In this manner, we are able to ensure a uniform and especially large flow of the blast medium per unit time to the sling wheel.

For example, we have found that when the sling wheel is driven at a speed of 1,000 rpm or greater, we are able in this manner to supply several cubic meters per hour of synthetic resin granules to the sling wheel to act as the deburring or coating-removing blast medium.

This ensures especially economical operation.

According to another feature of the invention, the supply bin or silo is provided with an agitator which is continuously or intermittently driven and serves to prevent adhesion of the particles or granules of the blast medium to one another.

The blast medium, when confronting cryogenic temperatures, especially low temperatures which may feed back from the deburring chamber into the supply bin, tends to ice up or to sustain adhesion of the particles together at these low temperatures and to the walls of the supply bin or other surfaces thereof. An agitator continuously active within the supply bin in addition to or in conjunction with the force-feed device is thus able to prevent such adhesion or agglomeration.

An especially compact arrangement whereby nevertheless an agitator and the force-feed device have independent drives can be accomplished by providing the agitator shaft as a hollow shaft carrying agitator blades or arms while an inner shaft driven through the agitator shaft carries the force-feed worm below the terminus of this hollow agitator shaft. The drives for these two shafts can be mounted on the top of the silo or bin.

Practical testing has shown that the agitator can be operated effectively with a much lower speed in revolutions per minute than the force-feeder and that this system permits differentially driving the two shafts in an economical manner with individual speed controls.

Naturally it is possible to control the throughput of the blast medium by regulating the supply to the wheel and, therefore, the outflow from the supply bin by shifting the force-feeder axially, i.e. vertically, with the force-feeder being provided with a conical stopper or the like which can regulate the outflow cross section of the bin or the passage for the blast medium.

BRIEF DESCRIPTION OF THE DRAWING

The above and other objects, features and advantages of the present invention will become more readily apparent from the following description, reference being made to the accompanying drawing which shows an apparatus for the deburring of deep-cooled large-size article with a blast medium according to the invention. For articles of different sizes, different conveyor arrangements may be utilized and for the removal of coatings, the apparatus may be provided with means for separating the blast medium from the adherent or remove lacquer or coating. In the drawing.

SPECIFIC DESCRIPTION

Figure 1:
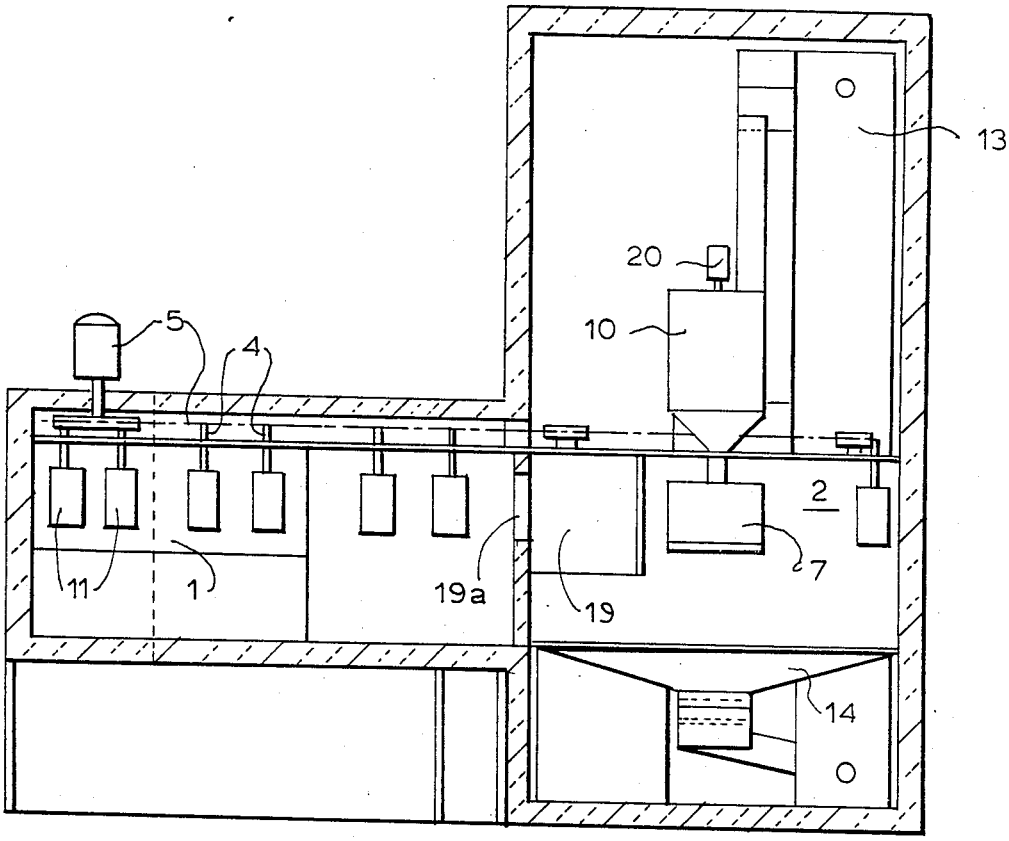
FIG. 1 is a diagrammatic vertical section through an apparatus embodying the invention.

The apparatus of the present invention as illustrated in the drawing serves for the deburring or decoating of objects or articles which are individually carried by a conveyor and are suspended therefrom to be entrained into the blast zone. In this system, the conveyor arrangement is such that the articles pass around the sling wheel which lies in a horizontal plane, by horizontal movement along a path which extends 360° around the axis of the sling wheel. Since the beam angle of the sling wheel also amounts to 360°, the articles are encountered by the blast medium over substantially their entire path within the blast chamber. Losses of the blast medium are thus kept to those losses which result by passage of the blast medium through the inlet and outlet openings of the blast chamber, a quantity which may be minimized by appropriate baffling of such openings.

In the embodiment illustrated, one can assume that comparatively large articles are to be deburred, such articles being, for example, respirator masks which may have been chilled before they enter the deburring chamber to cryogenic temperatures by contact with liquid nitrogen or some other low temperature medium to embrittle burrs and projections on these molded parts.

The apparatus comprises a feeder chamber 1 and a deburring chamber 2 which may be disposed adjacent a work station 3 at which the articles are individually mounted on an endless chain conveyor 5 from which the articles are suspended via respective hangers 4. The articles are removed as the chain exits the chamber 2 through an opening 18*a* and untreated articles are mounted on the hanger before the chain enters the chamber 1 via the opening 18*b* (FIG. 2).

The articles 11 are so mounted upon the hangers 4 that they can rotate freely about vertical axes, i.e. can swivel so that all sides of the articles are impacted by the blast medium.

Figure 2:
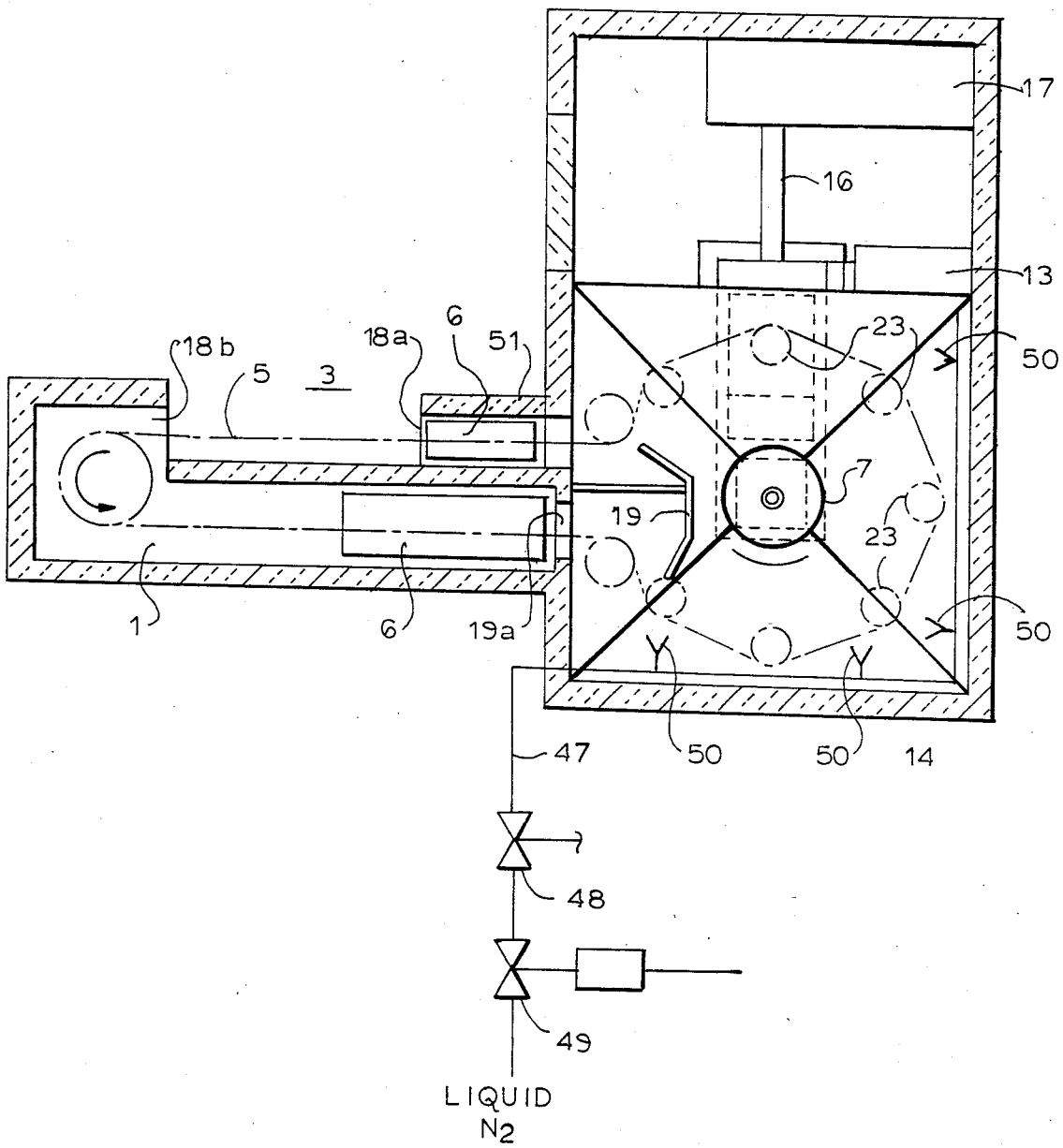
FIG. 2 is a diagrammatic horizontal section through this apparatus.

As will be apparent from FIG. 2, a cryogenic medium can be introduced via line 47 into the chamber 2 although the cryogenic medium can also be introduced into the chamber 1 by additional sprayheads other than the sprayheads 50 which are shown to be arrayed around the practically circular path of the articles in chamber 2. The cryogenic medium is, in this case, liquid nitrogen which is fed via a solenoid or magnetic valve 49 and a flow-regulating valve 48. The nozzles 50 can be shaped to conform to the configuration of the workpieces or can be arrayed in conformity thereto to ensure a uniform direction of the liquid nitrogen into the surfaces.

Because of this direct heat exchange with liquid nitrogen at least projecting portions or burrs of the workpieces are embrittled. The liquid nitrogen evaporates by contact with the workpeices and the cold gas which results traverses the feed chamber 1 and thereby precools the workpieces 11 before they enter the chamber 2.

The chain 5 passes around sprockets or rollers 23 within the deburring chamber 2 and around a sling wheel 7 which can be any conventional type, provided with pockets, passages or the like opening inwardly (see FIG. 6) so as to be capable of centrifugally through the blast medium outwardly. The blast medium is supplied from a bin or silo 10.

Figure 4:
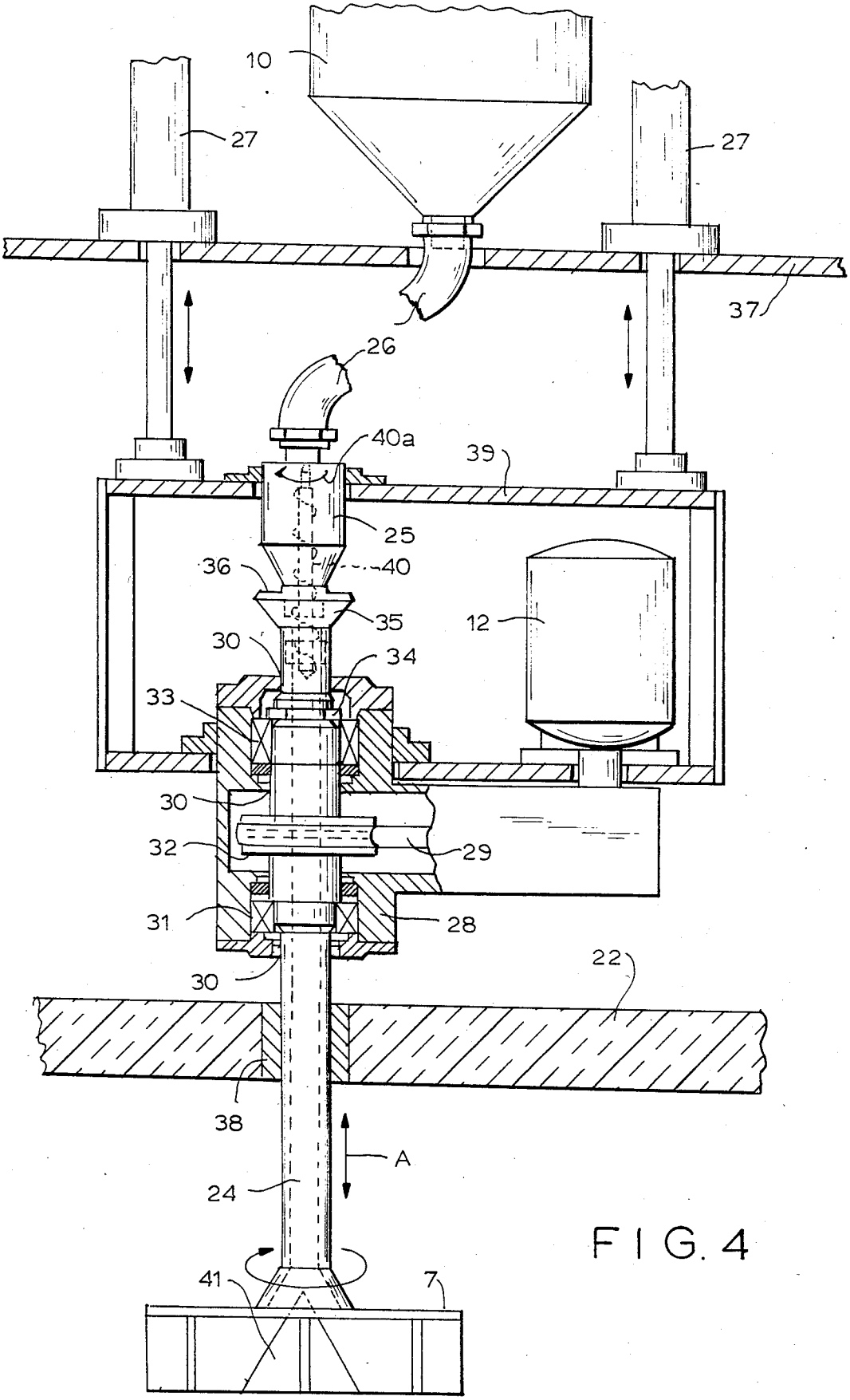
FIG. 4 is a detail view of a mounting for the sling wheel showing the means for oscillating same.

The sling wheel 7 is cantilever journaled and is driven by a motor or drive system which has not been illustrated in detail except in FIG. 4 but is located above the roof 22 of the treatment chamber 2.

The suspension path of the workpieces lies at a practically constant distance from the sling wheel 7 and substantially in a circular path around the latter so that the workpieces are subjected to the particle blast over this entire path and, by reason of the rotation of the workpieces about individual vertical axes, the workpieces are subjected to contact with the particles on all sides.

After the workpieces have been contacted by the particles and been deburred, they leave the chamber 2 and are removed from the chain 5. The walls and roof of the chamber are thermally insulated to minimize the incursion of heat and the openings 18*a* and 18*b* can be provided with gas locks (not shown) limiting the loss of cold gas.

The used blast medium and particles removed from the workpieces are deposited in a collection trough 14 and are from there carried to a vibration sieve 8 which separates the reusable blast particles from pieces of rubber or the like removed during the deburring action from the workpieces. The reusable blast particles are carried by a bucket conveyor 13 or one or more flexible worms or screw conveyors back to the bin 10 (see FIG. 3).

Dust which is removed from the blast medium is collected by a dust-removing blower at 9 from the head of the bucket conveyor and from the sieve 8 and is delivered via ducts 15 and 16 to a filter chamber 17.

A baffle 19 is provided ahead of the opening 19*a* in the wall between the chambers 2 and 3 so that particles are not slung through this opening to be lost.

Figure 3:
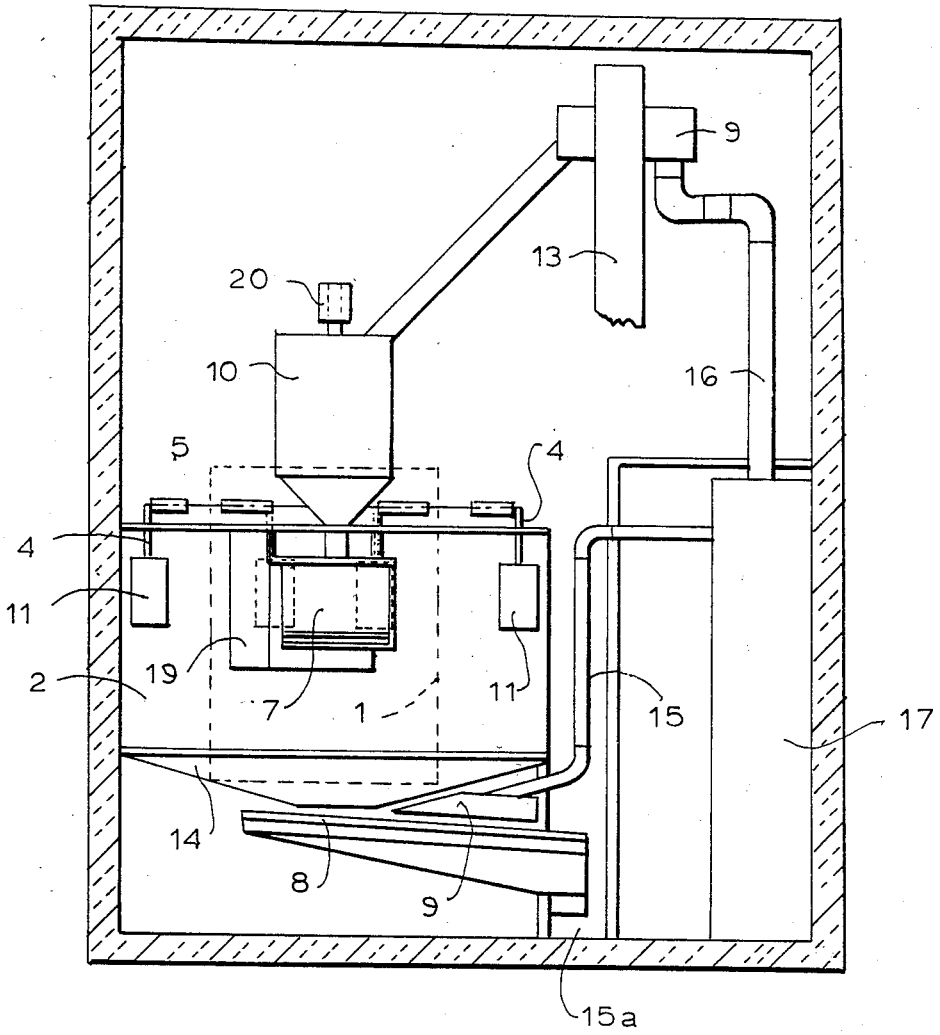
FIG. 3 is a diagrammatic vertical section taken in a plane in a right angle to the section of FIG. 1.

The bin is provided with an agitator whose drive has been represented diagrammatically at 10 in FIGS. 1 and 3 and a collector or container 15*a* is provided for the deburring residues separated from the recycled blast medium.

In spite of the presence of the baffle 19, blast medium can enter the chamber 1 and the outlet chamber 51 and these units can be provided with vibratory conveyors 6 to return this blast medium to, for example, the trough 14 for recovery.

To protect moving parts such as drives, pneumatic cylinders and the like from the cold within the chamber, these elements are provided to the extent possible outside the cooled chamber and, where moving parts are provided within the chambers, they may be protected by heated sleeves or jackets. The liquid nitrogen spray cools the work pieces and even the residues substantially uniformly over the entire duration of the operation.

In FIG. 4 we have shown a detail of the drive for the sling wheel 7 around which the workpieces are displaced along a horizontal path in the manner previously described. To ensure a blast treatment of these workpieces over their entire heights, the blast wheel 7 is vertically oscillated as represented by the arrow A.

The cantilever journaling of the sling wheel 7 permits its bearing and the drive mechanism to be located whooly externally of the treatment chamber which is exposed to the cold generated by the cryogenic fluid. The sling wheel 7 is mounted upon a hollow shaft 24 through which the blast medium is fed to the sling wheel. The supply of the blast medium through the hollow shaft is effected from the bin 10 via a flexible (rubber) tube 26 which communicates with a feeder receptacle 25.

A belt drive is utilized to rotate the hollow shaft at a high speed, e.g. upwardly of 1,000 rpm and comprises an electric motor 12 whose drive wheel has not been shown but engages a V-belt 29 which passes around the V-portion 32 connected to the hollow shaft 24 and contained within a transmission housing 28.

The transmission and the feed container 25 are mounted on a common support 39 which can be displaced vertically by at least one pneumatic cylinder 27 to effect the vertical oscillation as represented by the arrow A. The transmission housing is provided with seals 30 and these protect the bearings 31 and 33 in the transmission housing 28 against the incursion of the cryogenic fluids and particulates. The bearing 31 is a double-row cylinder roller bearing whereas the bearing 33 can be an axial, inclined ball bearing, i.e. a self-aligning bearing capable of taking up axial thrust but also providing radial journaling.

At 35, we have shown a funnel for guiding the blast medium into the interior of the hollow shaft and which is connected by a rubber sealing ring 36 with the lower end of the feed receptacle 25.

The pneumatic cylinders 27 are braced upon a fixed support 37. Between the hollow shaft 24 and the insulating sealing 22, a heated sleeve 38 can be provided to prevent damage to the resulting sliding bearing because of the cold conditions prevailing within the treatment chamber.

The blast medium is force-fed via a worm 40 to the hollow shaft 24 and the worm 40 may be driven as represented by the arrow 40*a* by means not shown independently of the hollow shaft or can be coupled to the hollow shaft for rotation therewith.

Figure 6:
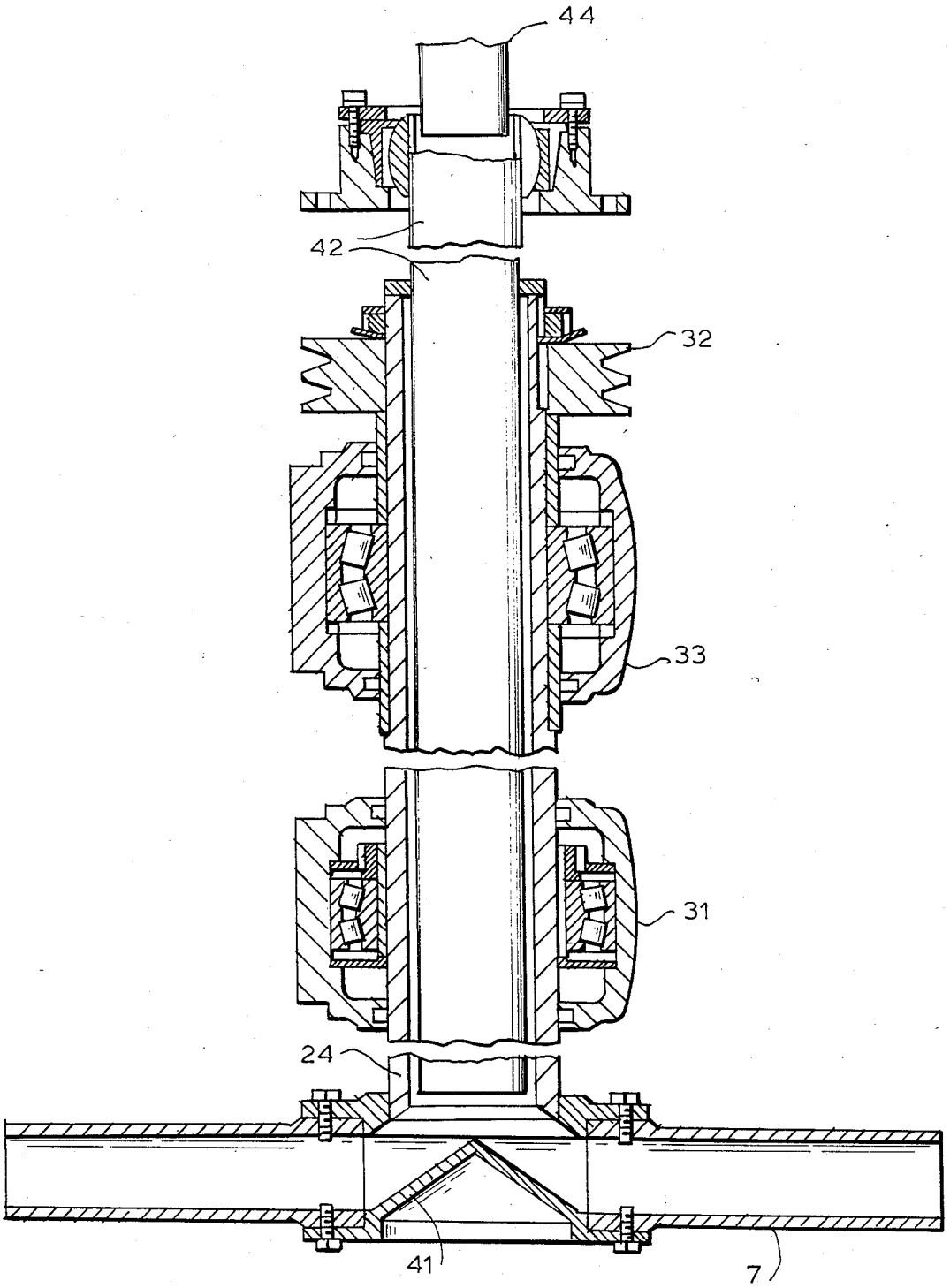
FIG. 6 is an axial section through another hollow shaft assembly for the sling wheel.

A conical body 41 in the region at which the particles are transferred from the hollow shaft to the wheel 7 diverts the particles outwardly and promotes the centrifugal distribution thereof (see also FIG. 6). Since the transmission, driving the sling wheel and the means feeding it are all located outside the cold box and the treatment region, there is little tendency toward failure. Hence this construction is also preferred when an oscillation is not to be imparted to the sling wheel.

Figure 5:
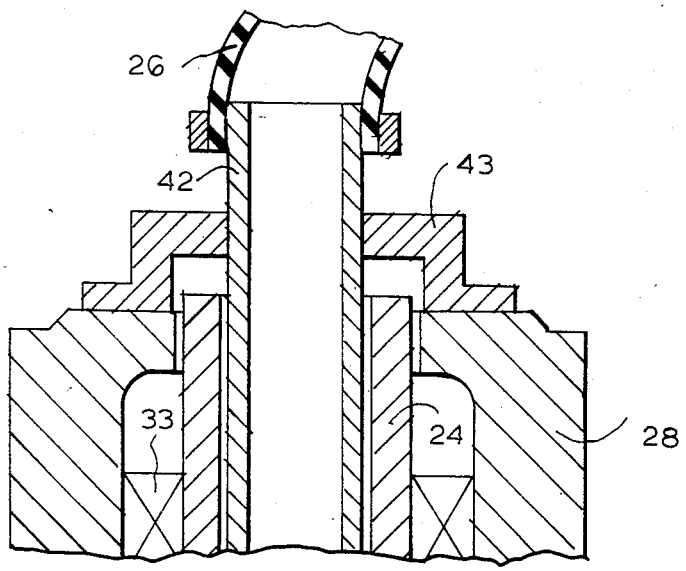
FIG. 5 is a detail view corresponding to FIG. 4 but illustrating an alternative means for feeding the blast medium, the detail being shown in axial section.

In FIG. 5 the connection between the tube 26 and the hollow shaft 24 has been shown in greater detail. In this arrangement the hollow shaft 24 terminates within the transmission housing 28 and a nonrotatable inner tube 42 extends into the hollow shaft 24, i.e. telescopically engages the latter.

This nonrotatable tube 42 which receives the blast medium from the hose 26 thus can transfer the blast medium directly to the wheel 7, reaching down to the lower end of the hollow shaft 24 so that the blast medium need never contact the rapidly rotating inner wall of the hollow shaft.

In this case, the high rotational speed of the hollow shaft need not contribute to a centrifugal retardation of the downward move to the blast medium to the slide wheel.

In this embodiment, the feed worm 40 can also be provided and can be driven by an independent drive if desired.

A particularly advantageous embodiment of the feeding system has been illustrated in FIG. 6 in which the hollow shaft 24, provided with the bearings 31 and 33 and the V-belt pulley 32, as described, can be traversed by the nonrotatable tube 42. In this embodiment, the bin or silo can be mounted directly above or in line with the hollow shaft 24 and can have a stationary drop tube 44 which extends into the nonrotatable tube 42 with play. The tube 44 remains in communication with the tube 42 notwithstanding the vertical and even pendulous oscillation of this tube and the hollow shaft 24 telescopically receiving it.

Figure 7:
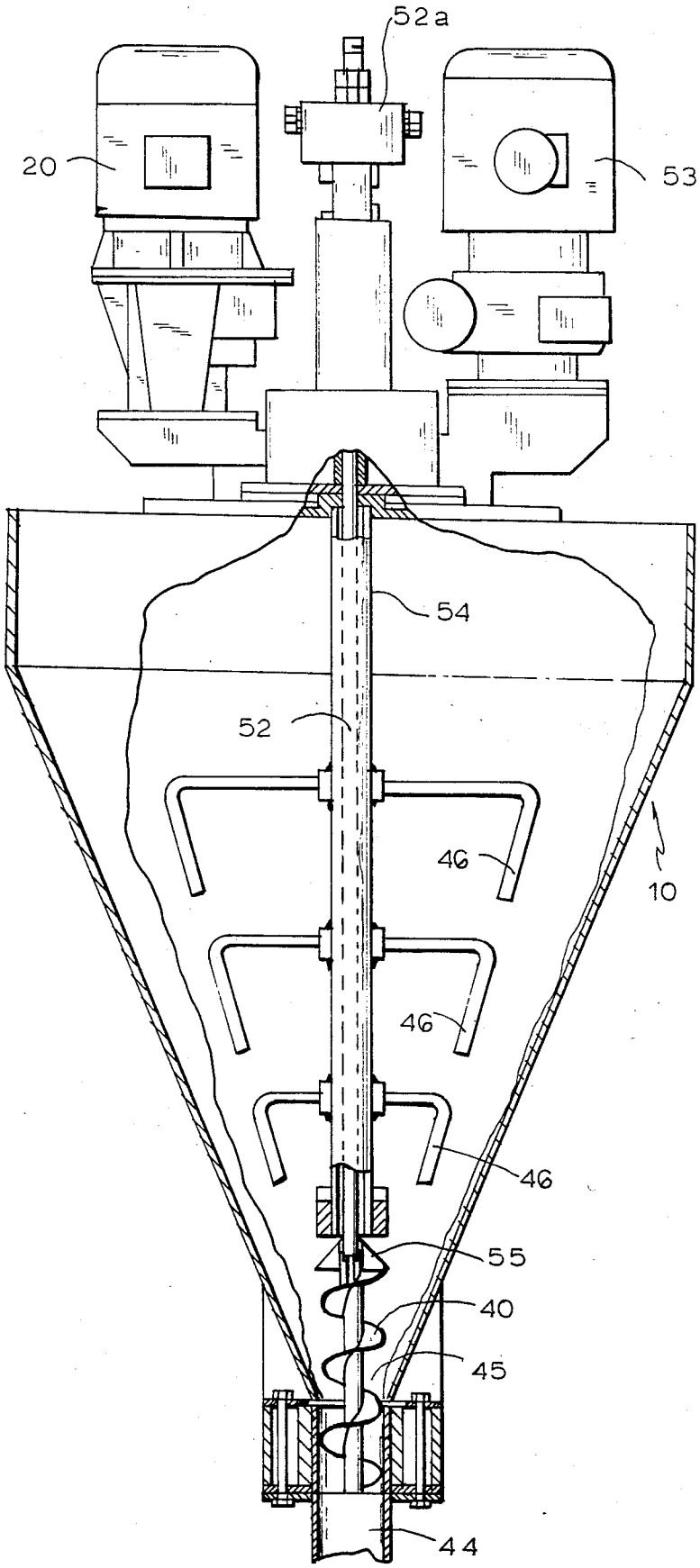
FIG. 7 is a diagrammatic vertical section through a supply bin which can be utilized for feeding the blast medium to the apparatus.

In the embodiment of FIG. 7 the tube 44 can be seen directly below the bin 100 which conically converges downwardly towards its outlet 45 where it communicates with the stationary tube 44.

An agitator 46 is rotatable within the bin 10 and comprises a number of arms or blades vertically spaced apart along a hollow shaft 54 which is driven by a drive 20 via a suitable transmission.

Within the hollow shaft 54, a shaft 52 extends and carries at its lower end a worm 40 which force-feeds the blast medium to the pipe 44, i.e. is a metering worm. The shaft 52 is driven by the drive 53 by a suitable transmission and the drives 20 and 53 have independent speed controls.

The agitator 46, 54, 20, therefore, serves only to loosen the blast medium and prevent adhesion or agglomeration of the particles while the worm 40 controls the tube at which these particles are fed to the sling wheel. The worm 40, is, of course, driven at higher speeds for this purpose.

While the various drives, including the drive for the chain 5, have been indicated to be continuously operable, they also may be operated periodically.

The shaft 52 is vertically shiftable, e.g. by a controller 52*a*, and carries a frustoconical stopper 55 which cooperates with the conical outlet 45 to control the free outflow cross section for the blast medium and permit the throughput to be regulated.

We claim:

1. An apparatus for the surface treatment of workpieces with a granular blast medium, comprising:

a housing forming a treatment chamber;

transport means for entraining workpieces to be treated through said housing;

means for connecting said workpieces with a deep-cooling fluid to embrittle at least surface portions of said workpieces to render them susceptible to removable by contact with said blast medium;

a sling wheel in said chamber positioned upon rotation to cast said blast medium against said workpieces;

a hollow shaft carrying said sling wheel and provided with means for the cantilever journaling thereon with respect to said housing whereby said sling wheel is mounted at a free end of said hollow shaft;

a nonrotatable tube extending into said hollow shaft for feeding said blast medium therethrough to said sling wheel; and a feed bin connected with said nonrotatable tube for supplying said blast medium thereto, said sling wheel lying in a substantially horizontal plane and is rotatable on said hollow shaft about a substantially vertical axis, said workpieces being carried along a substantially horizontal path around said sling wheel; and means for vertically oscillating said sling wheel and said hollow shaft relative to said path, said bin being vertically fixed and being provided with a fixed pipe communicating with said hollow shaft during the vertical oscillation thereof, said fixed pipe extending into said tube and said tube being vertically oscillated with said hollow shaft.

2. The apparatus defined in claim 1 wherein said sling wheel is provided with a conical body at the end of said hollow shaft for deflecting said blast medium outwardly.

3. The apparatus defined in claim 1, further comprising means between said hollow shaft and said bin for forcibly metering said blast medium through said hollow shaft to said sling wheel.

4. The apparatus defined in claim 3 wherein the last mentioned means includes a metering worm.

5. The apparatus defined in claim 1 wherein said bin is provided with an agitator.

6. The apparatus defined in claim 5 wherein a metering worm is provided for advancing said blast medium to said sling wheel.

7. The apparatus defined in claim 1 wherein said bin is provided with a vertically slidable member cooperating with a conical outlet portion thereof for controlling the outflow of said blast medium.

8. An apparatus for the surface treatment of workpieces with a granular blast medium, comprising:

a housing forming a treatment chamber;

transport means for entraining workpieces to be treated through said housing;

means for connecting said workpieces with a deep-cooling fluid to embrittle at least surface portions of said workpieces to render them susceptible to removal by contact with said blast medium, a sling wheel in said chamber positioned upon rotation to cast said blast medium against said workpieces;

a hollow shaft carrying said sling wheel and provided with means for the cantilever journaling thereon with respect to said housing whereby said sling wheel is mounted at a free end of said hollow shaft;

a nonrotatable tube extending into said hollow shaft for feeding said blast medium therethrough to said sling wheel; and a feed bin connected with said nonrotatable tube for supplying said blast medium thereto, said bin being provided with an agitator, a metering worm being provided for advancing said blast medium to said sling wheel, said agitator including a hollow shaft provided with arms and an agitator drive in said bin, said worm being provided with an inner shaft extending through the hollow shaft of said agitator and formed with an independent worm drive, said worm being disposed below said agitator in said bin.

9. The apparatus defined in claim 8 wherein said bin is provided with a vertically slidable member cooperating with a conical outlet portion thereof for controlling the outflow of said blast medium.

* * * * *